US008948664B2

(12) United States Patent
Shin et al.

(10) Patent No.: US 8,948,664 B2
(45) Date of Patent: Feb. 3, 2015

(54) DEVELOPING DEVICE CONVEYING ASSEMBLY FOR IMAGE FORMING APPARATUS AND IMAGE FORMING APPARATUS HAVING THE SAME

(75) Inventors: Jae Hyun Shin, Seoul (KR); Seung Gweon Lee, Suwon-si (KR); Ki Hyun Yoo, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 308 days.

(21) Appl. No.: 13/548,386

(22) Filed: Jul. 13, 2012

(65) Prior Publication Data

US 2013/0022375 A1 Jan. 24, 2013

(30) Foreign Application Priority Data

Jul. 14, 2011 (KR) ..... 10-2011-0069776

(51) Int. Cl.
*G03G 15/08* (2006.01)

(52) U.S. Cl.
CPC ..... *G03G 15/0808* (2013.01); *G03G 15/0891* (2013.01); *G03G 2215/0685* (2013.01)
USPC ..... 399/281

(58) Field of Classification Search
USPC ..... 399/281
See application file for complete search history.

(56) References Cited

U.S. PATENT DOCUMENTS

2008/0159789 A1* 7/2008 Sugimoto et al. ..... 399/254

FOREIGN PATENT DOCUMENTS

JP 2010-175984 A 8/2010

* cited by examiner

*Primary Examiner* — Quana M Grainger
(74) *Attorney, Agent, or Firm* — Staas & Halsey LLP

(57) ABSTRACT

A developing device of an image forming apparatus to convey a developing agent, the developing device including a housing having a developing agent accommodating compartment disposed therein, a first rotation member and a second rotation member that are disposed inside the developing agent accommodating compartment, a plurality of developing agent convey members that rotate around the first rotation member and the second rotation member being arranged along a shaft direction of the first rotation member, and at least one torque limiter coupled to between the first rotation member and at least one of the plurality of developing agent convey members, the at least one torque limiter to allow at least one of the plurality of developing agent convey members to perform a relative rotation with respect to the first rotation member when a load is applied to the plurality of developing agent convey members is varied.

31 Claims, 9 Drawing Sheets

DEVELOPING DEVICE CONVEYING ASSEMBLY FOR IMAGE FORMING APPARATUS AND IMAGE FORMING APPARATUS HAVING THE SAME

CROSS-REFERENCE TO RELATED APPLICATIONS

This application claims priority under 35 U.S.C. §119(a) from Korean Patent Application No. 2011-0069776, filed on Jul. 14, 2011 in the Korean Intellectual Property Office, the disclosure of which is incorporated herein in its entirety by reference.

BACKGROUND OF THE INVENTION

1. Field of the Invention

Embodiments of the present general inventive concept relate to a developing device of an image forming apparatus having a structure to convey a developing agent stored in a developing agent accommodating compartment, and an imaging forming apparatus having the same.

2. Description of the Related Art

An image forming apparatus represents an apparatus configured to form an image on a printing medium. The image forming apparatus includes a printer, a copy machine, a facsimile, and a multi-functional equipment incorporating the functionalities of the printer, the copy machine, and the facsimile.

An electrophotographic image forming apparatus, as an example of the image forming apparatus, is provided with a photoconductor, a light scanning apparatus, and a developing device. The light scanning apparatus scans light onto a photoconductor charged with a predetermined potential to form an electrostatic latent image on the surface of the photoconductor. The developing device provides the electrostatic latent image with a developing agent to form a visible image.

The visible image formed on the photoconductor is directly transferred to a printing medium or transferred through an intermediary transfer apparatus to a printing medium. The image transferred to the printing medium is fixed to the printing medium.

In general, a developing device is provided with a developing agent accommodating compartment, a developing agent conveying apparatus, and a developing member. The developing agent accommodating compartment stores a developing agent. The developing agent conveying apparatus delivers a developing agent from the developing agent accommodating compartment to the developing member. The developing member provides a photoconductor with the developing agent to form a visible image.

SUMMARY OF THE INVENTION

Exemplary embodiments of the present general inventive concept provide a developing device of an image forming apparatus capable of minimize and/or prevent parts from being damaged with a structure to convey a developing agent of the developing device, and an image forming apparatus having the same.

Additional features and utilities of the present general inventive concept will be set forth in part in the description which follows and, in part, will be apparent from the description, or may be learned by practice of the present general inventive concept.

In exemplary embodiments of the present general inventive concept, a developing device of an image forming apparatus includes a housing, a first rotation member, a second rotation member, a plurality of developing agent convey members and at least one torque limiter. The housing of the image forming apparatus has a developing agent accommodating compartment disposed therein. The first rotation member and the second rotation member are disposed inside the developing agent accommodating compartment. The plurality of developing agent convey members rotate around the first rotation member and the second rotation member, the plurality of developing agent convey members being arranged along a shaft direction of the first rotation member. The at least one torque limiter is coupled to between the first rotation member and at least one of the plurality of developing agent convey members. The at least one torque limiter allows at least one of the plurality of developing agent convey members to perform a relative rotation with respect to the first rotation member when a load is applied to the plurality of developing agent convey members in varied degrees.

The developing device further includes a first power transmission mechanism to connect the at least one torque limiter to the first rotation member such that a slip is allowed between the at least one torque limiter and the first rotation member.

The first power transmission mechanism includes at least one first protrusion to protrude from the first rotation member, and at least one second protrusion to protrude from an inner surface of the torque limiter radially inward the torque limiter. The at least one first protrusion or the at least one second protrusion is provided at one side thereof with a slip guide unit that guides a slip between the at least one first protrusion and the at least one second protrusion.

The developing device further includes a second power transmission mechanism to connect the plurality of developing agent convey members to the at least one torque limiter such that the plurality of developing agent convey members rotate while being engaged with the at least one torque limiter.

The second power transmission mechanism includes at least one third protrusion to protrude from an outer surface of the at least one torque limiter radially outward from the at least one torque limiter, and at least one accommodation hole formed through the plurality of developing agent convey members to accommodate the at least one third protrusion.

The torque limiter includes a plurality of first slit units, each of which is formed by slitting a side surface of the torque limiter in a circumferential direction of the torque limiter while interposing the third protrusion therebetween such that the third protrusion elastically moves in a radial direction of the torque limiter.

The torque limiter includes at least one through hole which penetrates a side surface of the torque limiter to reduce a resistive force applied by a developing agent existing between the torque limiter and the first rotation member.

The at least one torque limiter is coupled at one end or at both ends of the first rotation member in the shaft direction of the first rotation member.

The first rotation member includes a rotation shaft, a plurality of agitator ribs and a support unit. The rotation shaft rotates when a driving force is received. The plurality of agitator ribs extend from the rotation shaft toward a radial direction of the first rotation member to stir a developing agent accommodated in the developing agent accommodating compartment. The support unit is provided on at least one of the rotation shaft and the plurality of agitator ribs to support the torque limiter. The support unit includes a first support surface to support the torque limiter against movement in the shaft direction of the first rotation member and a second support surface to support the torque limiter against movement in the radial direction of the first rotation member.

The torque limiter includes a separation preventing unit that protrudes from an inner surface of one end of the torque limiter toward a center of the torque limiter to prevent the torque limiter from being separated from the first rotation member in the shaft direction of the first rotation member.

The torque limiter includes a plurality of second slit units, each of which is slit at a side surface of the torque limiter in the shaft direction of the torque limiter while interposing the separation preventing unit therebetween such that the separation prevention unit elastically moves in a radial direction of the torque limiter.

The plurality of developing agent convey members includes a first developing agent convey member and a third developing agent convey member that are disposed at opposite ends of the first rotation member in the shaft direction of the first rotation member, and a second developing agent convey member disposed between the first developing agent convey member and the third developing agent convey member.

At least one of the first developing agent convey member and the third developing agent convey member a relative motion with respect to the second developing agent convey member.

The developing device further includes a third power transmission mechanism to connect the second developing agent convey member to the first rotation member such that the second developing agent convey member rotates while being engaged with the first rotation member.

The third power transmission mechanism includes at least one fourth protrusion to protrude from the first rotation member, and at least one coupling hole formed through the second developing agent convey member in a rotation direction of the second developing agent convey member to accommodate the at least one fourth protrusion.

If one of the first developing agent convey member and the third developing agent convey member is overloaded, the torque limiter, which is coupled between the overloaded developing agent convey member and the first rotation member, performs a relative rotation with respect to the first rotation member.

The plurality of developing agent convey members are belts.

Exemplary embodiments of the present general inventive concept may also provide an image forming apparatus includes a body, a photoconductor which is disposed inside the body and has an electrostatic latent image formed thereon, and a developing device to provide the photoconductor with a developing agent. The developing device includes a developing agent accommodating compartment, at least one rotation member, a plurality of developing agent convey members, and a plurality of torque limiters. The at least one rotation member is disposed in the developing agent accommodating compartment. The plurality of developing agent convey members convey the developing agent existing in the developing agent accommodating compartment while rotating around the rotation member. The plurality of torque limiters are disposed between the at least one rotation member and the plurality of developing agent convey members and are coupled to the at least one rotation member and the plurality of developing agent convey members such that at least one of the plurality of developing agent convey members performs a relative motion with respect to remaining developing agent convey members of the plurality of developing agent convey members.

The image forming apparatus further includes at least one first protrusion and at least one second protrusion. The at least one first protrusion protrudes from the at least one rotation member. The at least one second protrusion protrudes from at least one of the plurality of torque limiters and is engaged to or separated from the first protrusion according to a size of a load applied to the plurality of developing agent convey members.

The image forming apparatus further includes a plurality of accommodation holes and at least one third protrusion. The plurality of accommodation holes are formed through at least one of the plurality of developing agent convey members and are arranged in a rotation direction of the plurality of developing agent convey members. The at least one third protrusion protrudes from at least one of the plurality of torque limiters and is coupled to the plurality of accommodation holes to transmit a rotary force to the at least one of the plurality of developing agent convey members.

The torque limiter further includes at least one first elastic piece which has sides that are slit in a circumferential direction of the torque limiter. The second protrusion protrudes from the first elastic piece toward a center of the torque limiter.

The third protrusion protrudes from the first elastic piece in an opposite direction to the second protrusion.

The plurality of torque limiters are coupled at opposite ends of the rotation member.

The torque limiter further includes at least one second elastic piece which has sides that are slit in a shaft direction of the torque limiter.

The torque limiter includes a separation preventing member to protrude from an inner surface of the second elastic piece to prevent the torque limiter from being separated from the rotation member.

The plurality of developing agent convey members includes a first developing agent convey member and a third developing agent convey member that are disposed at opposite ends of the at least one rotation member in a shaft direction of the at least one rotation member, and a second developing agent convey member disposed between the first developing agent convey member and the third developing agent convey member. The first developing agent convey member and the third developing agent convey member perform a relative motion with respect to the second developing agent convey member.

Exemplary embodiments of the present general inventive concept also provide a developing agent convey apparatus of an image forming apparatus, including a first rotation member and a second rotation member disposed in a developing agent accommodating compartment and that are spaced apart from one another by a predetermined interval, a plurality of developing agent convey members to convey developing agent stored the developing agent accommodating compartment while rotating around the first rotation member and the second rotation member, and a torque limiter that is coupled to the first rotation member and the plurality of developing agent convey members, the torque limiter being disposed between first rotation member and the plurality of developing agent convey members.

The developing agent convey apparatus may also include a first power transmission member to connect the torque limiter to the first rotation member such that a slip occurs between the torque limiter and the first rotation member when a force that is greater than a predetermined overloading force is applied to at least one of the plurality of developing agent convey members.

The developing agent convey apparatus may also include a second power transmission member to connect the plurality of developing agent convey members to the torque limiter such that the plurality of developing agent convey members rotate when engaged with the torque limiter.

The plurality of developing agent convey members may include a first developing agent convey member and a third developing agent convey member that are disposed at opposite ends of the first rotation member in the shaft direction of the first rotation member, and a second developing agent convey member disposed between the first developing agent convey member and the third developing agent convey member.

The developing agent convey apparatus may include that when one of the first developing agent convey member and the third developing agent convey member is overloaded, the torque limiter, which is coupled between the overloaded developing agent convey member and the first rotation member, to rotate relative to the first rotation member.

As described above, the parts of the developing device of the image forming apparatus are prevented from being damaged or deformed caused by a load applied when the developing agent is being conveyed.

The developing agent is effectively conveyed by the developing agent convey member, thereby preventing the degradation of the image caused by the failure to supply a developing agent.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
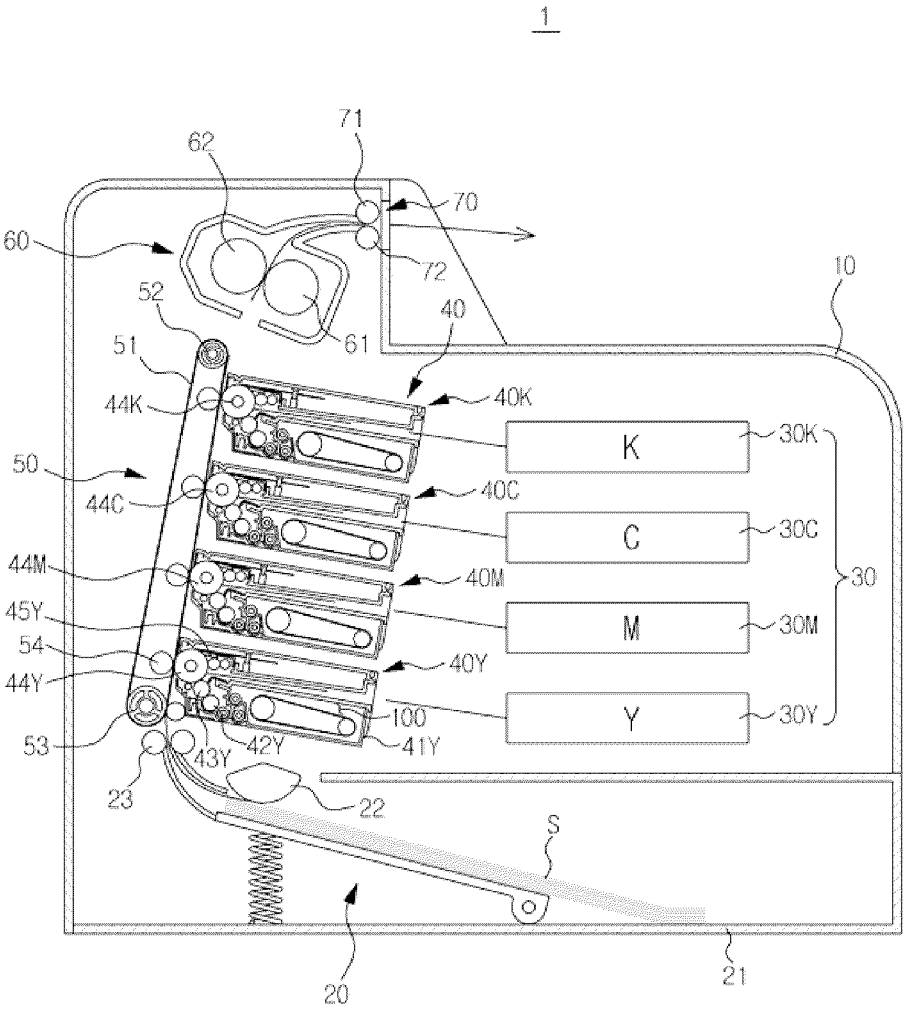
FIG. 1 is a view illustrating an image forming apparatus according to exemplary embodiments of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept while referring to the figures.

Referring to FIG. 1, an image forming apparatus 1 includes a body 10, a printing medium supply unit 20, a light scanning unit 30, a developing unit 40, a transfer unit 50, a fuser unit 60, and a printing medium discharge unit 70.

The body 10 forms an external appearance of the image forming apparatus 1 and supports respective parts installed in the image forming apparatus 1, as described in detail below.

The printing medium supply unit 20 includes a cassette 21 in which a printing medium (S) is stored, a pick-up roller 22 to pick up the printing medium (S) one by one, and a convey roller 23 to convey the picked up printing medium toward the transfer unit 50.

The light scanning unit 30 includes four light scanning devices 30Y, 30M, 30C, and 30K that are configured, according to a printing signal, to radiate light corresponding to image information on a respective color among Yellow (Y), Magenta (M), Cyan (C), and Black (K) to photoconductors 44Y, 44M, 44C, and 44K of developing devices 40Y, 40M, 40C, and 40K, respectively. The light scanning unit 30 may include a light source (e.g., a laser, a light emitting diode, a lamp, etc.) and one or more beam scanning mirrors to scan the light emitted from the light source so as to radiate the light corresponding to the image information. An electrostatic latent image is formed on each of the photoconductors 44Y, 44M, 44C, and 44K by the light radiated by the four light scanning devices 30Y, 30M, 30C, and 30K.

The developing unit 40 includes the developing devices 40Y, 40M, 40C, and 40K that accommodate different color developing agents, that is, a Yellow ("Y") color developing agent, a Magenta ("M") color developing agent, a Cyan ("C") color developing agent, and, a Black ("B") color developing agent, respectively. The following description will be made in relation to the developing device 40Y accommodating a Yellow color developing agent as an example. However, the following description, unless otherwise noted, can be applied to the remaining developing devices 40M, 40C, and 40K accommodating Magenta, Cyan, and Black developing agents.

The developing device 40Y is provided with a housing 41Y, a developing agent accommodating compartment 100, a developing agent supply member 42Y, a development member 43Y, and a photoconductor 44Y.

The developing agent accommodating compartment 100 is formed inside the housing 41Y to store the developing agent that is to be supplied to the photoconductor 44Y. The developing agent supply member 42Y is installed on the housing 41Y to supply the development member 43Y with the developing agent stored in the developing agent accommodating compartment 100. The development member 43Y attaches a developing agent to the surface of the photoconductor 44Y on which an electrostatic latent image is formed by the light scanning device 30Y. The photoconductor 44Y is rotatably installed at a front end of the housing 41Y to receive a developing agent from the development member 43Y. Although the photoconductor 44Y according to exemplary embodiments of the present general inventive concept is integrally installed with the developing device 30Y, the present general inventive concept is not limited thereto. According to other exemplary embodiments of the present general inventive concept, the photoconductor 44Y may be installed separately from the developing device 40Y.

Charge roller 45Y can be configured to charge the photoconductor 44Y with a predetermined potential before light is radiated by the light scanning unit 30Y.

The transfer unit 50 can transfer a visible image formed on the photoconductor 44Y to a printing medium (e.g., a printing medium 'S'). The transfer unit 50 includes a printing medium convey belt 51, a driving roller 52, a driven roller 53, and a plurality of transfer rollers 54.

The printing medium convey belt 51 conveys the printing medium (e.g., a printing medium 'S'), which is supplied from the printing medium supply unit 20, to the plurality of photoconductors 44Y, 44Ma, 44C, and 44K.

The driving roller 52 and the driven roller 53 are installed on both ends of the printing medium convey belt 51 at an inner side of the printing medium convey belt 51. The driving roller 52 and the driven roller 53 are configured to rotate the printing medium convey belt 51 in a caterpillar manner. That is, the driving roller 52 and the driven roller 53 rotate about their respective rotational axes in the same direction to move the printing medium convey belt 51 in a predetermined direction.

The plurality of transfer rollers 54 are disposed to face the photoconductors 44Y, 44M, 44C, and 44K, respectively, while interposing the printing medium convey belt 51 therebetween such that visible images formed on the photoconductors 44Y, 44M, 44C, and 44K are transferred to a printing medium conveyed by the printing medium convey belt 51. That is, the printing medium S in the printing medium supply unit 20 is conveyed by the pick-up roller 22 and the convey roller 23 to the printing medium convey belt 51, which conveys the printing medium such that the visible images formed on the photoconductors 44Y, 44M, 44C, and 44K are transferred to the printing medium.

The fuser unit 60 includes a heating roller 61 having a heating source, and a pressure roller 62 installed facing the heating roller 61. When a printing medium passes through between the heating roller 61 and the pressure roller 62, the transferred image is fixed to the printing medium by a heat transferred from the heating roller 61 and a pressure applied by the heating roller 61 and the pressure roller 62. The printing medium is conveyed to the fuser unit 60 by the printing medium convey belt 51 that is driven by the rotational movement of the driving roller 52 and the driven roller 53.

The printing medium discharge unit 70 includes an exit roller 71 and an exit back-up roller 72 to discharge the printing medium passing through the fuser unit 60 to the outside the body 10.

Figure 2:
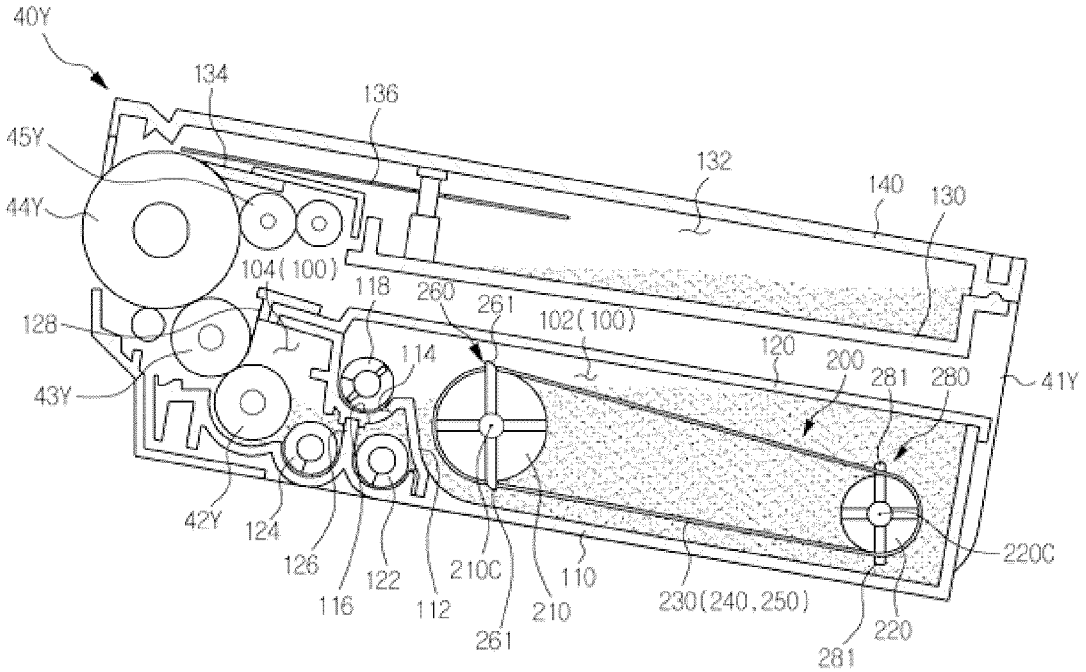
FIG. 2 is a cross-sectional view illustrating a developing device according exemplary embodiments of the present general inventive concept.
Figure 3:
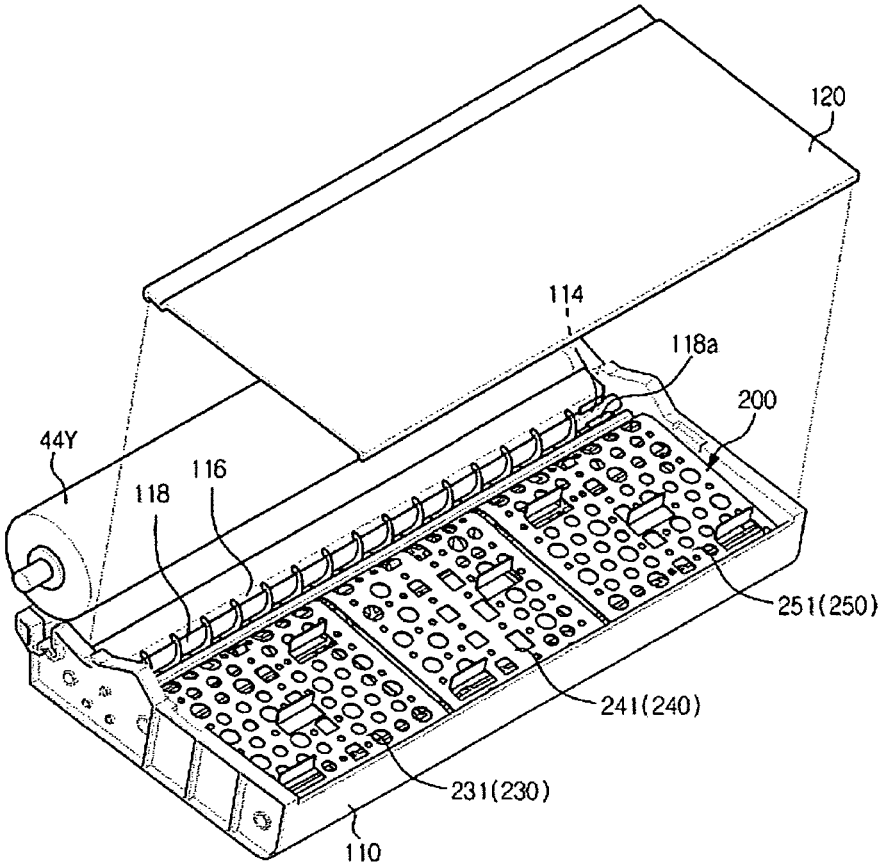
FIG. 3 is a perspective view illustrating parts of the developing device of FIG. 2.

FIG. 2 is a cross-sectional view illustrating a developing device according to exemplary embodiments of the present general inventive concept. FIG. 3 is a perspective view illustrating parts of the developing device of FIG. 2.

Referring to FIGS. 2 and 3, the housing 41Y includes a base frame 110, a cover 120, an upper frame 130 and an upper cover 140.

The base frame 110 supports various parts, as described below, that are accommodated inside the base frame 110. The cover 120 covers an upper portion of the base frame 110, thereby forming a developing agent accommodating compartment 100 to store a developing agent.

The upper frame 130 and the upper cover 140 are disposed at an upper side of the cover 120 to form a waste developing agent accommodating compartment 132 that is configured to store a waste developing agent collected from the photoconductor 44Y.

A cleaning member 134 is installed on the upper frame 130. The cleaning member 134 is configured to scratch, scrape, and/or remove the developing agent remaining on the surface of the photoconductor 44Y. The waste developing agent that is removed (e.g., that is scraped away) by the cleaning member 134 is conveyed by a waste developing agent convey member 136 and is stored in the waste developing agent accommodating compartment 132.

The waste developing agent convey member 136 is installed at an upper side of the cleaning member 134. The waste developing agent convey member 136 may be provided as a plate-type member. The waste developing agent convey member 136 may include plastic mold material or film having an elastic restoring force. In exemplary embodiments of the present general inventive concept, if the developing device 40Y is configured to have a lower height such that the height of the waste developing agent accommodating compartment 132 is reduced, and the waste developing agent convey member 136 is provided as a plate-type member, the waste developing agent can be conveyed.

The developing agent accommodating compartment 100 is divided into a first developing agent accommodating compartment 102 and a second developing agent accommodating compartment 104 by a partition 112. The first developing agent accommodating compartment 102 and the second developing agent accommodating compartment 104 communicate with each other through an inlet port 114 formed at one side of the partition 112. That is, inlet port 114 of partition 112 provides a path between the first developing agent accommodating compartment 102 and the second developing agent accommodating compartment 104 though which a developing agent can pass.

A developing agent convey apparatus 200 is disposed inside the first developing agent accommodating compartment 102. The developing agent convey apparatus 200 is configured to convey a part of the developing agent stored in the first developing agent accommodating compartment 102 toward the second developing agent accommodating compartment 104. That is, the developing agent convey apparatus 200 can convey developing agent through the inlet port 114 of partition 112 from the first developing agent accommodating compartment 102 to the second developing agent accommodating compartment 104. The developing agent convey apparatus 200 serves to convey the developing agent while stirring the developing agent containing in the first developing agent accommodating compartment 102.

The developing agent stored in the first developing agent accommodating compartment 102 is conveyed to an upper side of the first developing agent accommodating compartment 102 by the developing agent convey apparatus 200, and is provided to a developing agent receiving unit 116 provided on the partition 112. The developing agent provided to the developing agent seating unit 116 is conveyed to one side of the partition 112 by a supply auger 118, and freefalls to the second developing agent accommodating compartment 104 through the inlet port 114.

A first circulating auger 122, a second circulating auger 124, the developing agent supply member 42Y, the development member 43Y are disposed inside the second developing agent accommodating compartment 104.

The developing agent dropped in a freefall through the inlet port 114 of the partition 112 is circulated by the first and the second circulating augers 122 and 124. In exemplary embodiments of the present general inventive concept, a circulation wall 126 is interposed between the first and the second circulating augers 122 and 124. Such a circulation delivers the developing agent to the development member 43Y by passing through the developing agent supply member 42Y. The developing agent delivered to the development member 43Y is regulated by a regulating apparatus 128. That is, the amount of developing agent delivered to the developing member 43Y is regulated by the regulating apparatus 128. The developing agent is attached to the surface of the photoconductor 44Y on which an electrostatic latent image is formed, so that a visible image is formed.

The supply auger 118, the first and the second circulating augers 122 and 124, the developing agent supply member 42Y, and the development member 43Y supply the developing agent to the photoconductor 44Y. However, the configuration to supply the developing agent to the photoconductor 44Y is not limited thereto. For example, in an image forming apparatus having two component developing, the developing agent supply member 42Y may be omitted. In exemplary embodiments of the present general inventive concept, the developing agent supply member 42Y and the development member 43Y can be provided in a roller-type having a cylinder shape as illustrated in FIG. 2. However, the type of the developing agent supply member 42Y and the development member 43Y is not limited thereto. For example, the developing agent supply member 42Y and the development member 43Y may be a belt type or a brush type. In exemplary embodiments of the present general inventive concept, the convey elements 118, 122, and 124 are provided in an auger type in FIG. 2. However, the type of the convey elements are not limited thereto, and may be other types of convey elements.

When a predetermined and/or sufficient amount of developing agent is provided to the second developing agent accommodating compartment 104, the developing agent stops inflowing through the inlet port 114 and returns toward the developing agent convey apparatus 200 by a return blade 118*a* which is provided at an end of the supply auger 117 to correspond to a position of the inlet port 114.

Figure 4:
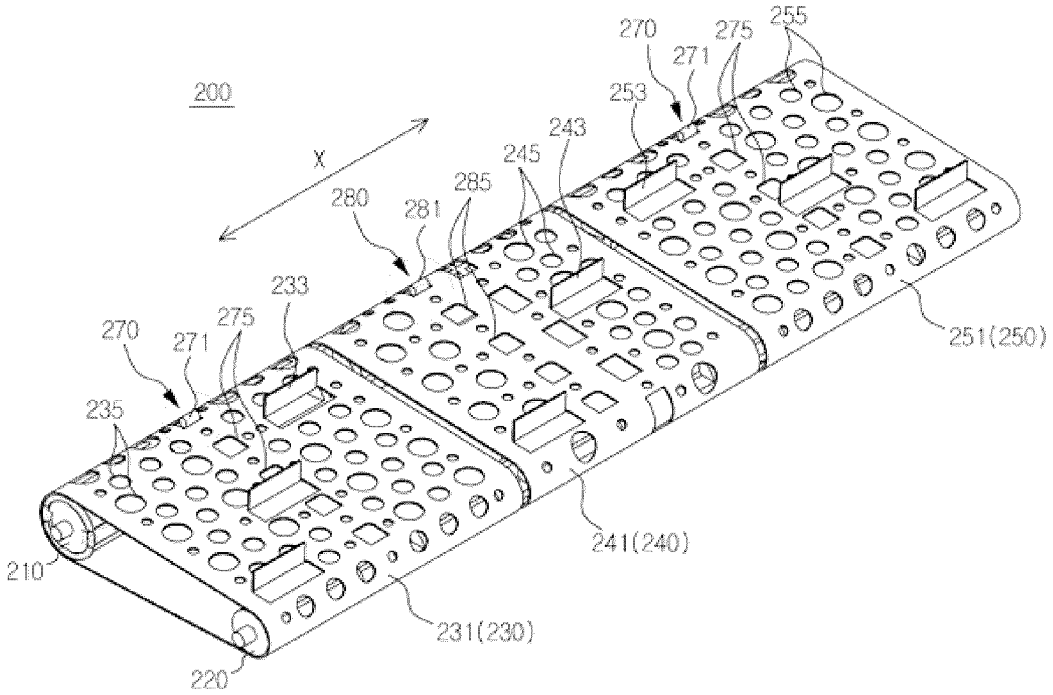
FIG. 4 is a perspective view illustrating a developing agent conveying apparatus according to exemplary embodiments of the present general inventive concept.

FIG. 4 is a perspective view illustrating a developing agent conveying apparatus according to exemplary embodiments of the present general inventive concept.

Referring to FIGS. 2 and 4, the developing agent convey apparatus 200 includes a rotation member 210, a second rotation member 220, a plurality of developing agent convey members 230, 240 and 250, and a torque limiter 290 which is coupled to the first rotation member 210 and the plurality of developing agent convey members 230 and 250 between the first rotation member 210 and the plurality of developing agent convey member 230 and 250. The first rotation member 210, the second rotation member 220, and the torque limiter 290 rotatably support the developing agent convey members 230, 240, and 250. The developing agent convey members 230, 240, and 250 convey the developing agent stored in the first developing agent accommodating compartment 102 while rotating around the first rotation member 210 and the second rotation member 220.

The first rotation member 210 is disposed adjacent to the partition 112 inside the first developing agent accommodating compartment 102. The second rotation member 220 is disposed at an opposite side to the first rotation member 210 and is spaced apart from the first rotation member 210 by a predetermined interval.

The first rotation member 210 rotates by receiving a power from a motor (not illustrated) installed inside the body 10, and transmits the received power by supporting an inner surface of one side of the second developing agent convey member 240. The second rotation member 220 supports inner surfaces of the other sides of the first and the third developing agent convey members 230 and 250, and rotates together with the developing agent convey members 230, 240, and 250.

The first rotation member 210 and the rotation member 220 may have a spiral-shape blade structure configured to stir the developing agent stored in the first developing agent accommodating compartment 102.

A center of rotation 210C of the first rotation member 210 may be provided at a higher position than a center of rotation 220C of the second rotation member 220. That is, the center of rotation 210C of the first rotation member 210 may be spaced apart by a greater distance from a bottom of the base frame 110 than the center of rotation 220C of the second rotation member 220. In this configuration, the developing agent of the first developing agent accommodating compartment 102 is minimized and/or prevented from being delivered to the second developing agent accommodating compartment 104 by gravity. Accordingly, the developing agent of the first developing agent accommodating compartment 102 is delivered by a conveying force of the developing agent convey members 230, 240, and 250, so that the supply amount of the developing agent is effectively adjusted. That is, the conveying force of the developing agent convey members 230, 240, and 250 adjusts the delivery of the developing agent from the first developing agent accommodating compartment 102.

The developing agent convey members 230, 240, and 250 may be one or more belts.

In general, when conveying a developing agent toward a supply member, a plurality of agitators is arranged along a transport direction of the developing agent. For a color image forming apparatus having a plurality of developing devices arranged one above the other, in order to reduce the vertical size of the color image forming apparatus, the height of each developing device needs to be lowered. Such a lowered height of the developing device results in reduction of the rotation radius of an agitator in the developing device. However, the reduction of the rotation radius of the agitator reduces a rotation radius by which the developing agent is stirred, and thus a conveyed portion of the developing agent is also reduced. Accordingly, in order to convey the developing agent, an increased number of agitators are required. However, the developing agent may be under stress by passing through the increased number of agitators. In addition, increasing the number of agitators may complicate the configuration of the developing device and may also complicate the power transmission mechanism to drive the agitator.

When a convey member is a belt, even if the height of the developing device is reduced, a developing agent is conveyed without a plurality of agitators while simplifying a power transmission mechanism and reducing the stress applied to the developing agent.

Developing agent convey belts 231, 241 and 251 each may be provided in the form of a film having, for example, a thickness of 2 mm or less. The developing agent convey belts 231, 241, and 251 may include polyethylene terephthalate (PET), Polycarbonate (PC), etc.

The developing agent convey belts 231, 241, and 251 can include a first developing agent convey belt 231 and a third developing agent convey belt 251, which are disposed at opposite ends of the first rotation member 210 in a shaft direction (an X direction, as illustrated in FIG. 4) of the first rotation member 210, and a second developing agent convey belt 241 disposed between the first developing agent convey belt 231 and the third developing agent convey belt 251.

The torque limiter 290 rotates by receiving a rotary force from the first rotation member 210 while being coupled to the first rotation member 210. The torque limiter 290 supports inner surfaces of one side of the each developing agent convey members 230 and 250 to transmit a rotary force. The torque limiter 290 enables at least one of the first developing agent convey belt 231 and the third developing agent convey belt 251 to perform a relative motion with respect to the first rotation member 210, thereby minimizing and/or preventing the first rotation member 210 from being affected by an overload that is created on the first developing agent convey belt 231 or the third developing agent convey belt 251 by a resistive force of a developing agent accommodated in the first developing agent accommodating compartment 102.

Figure 5:
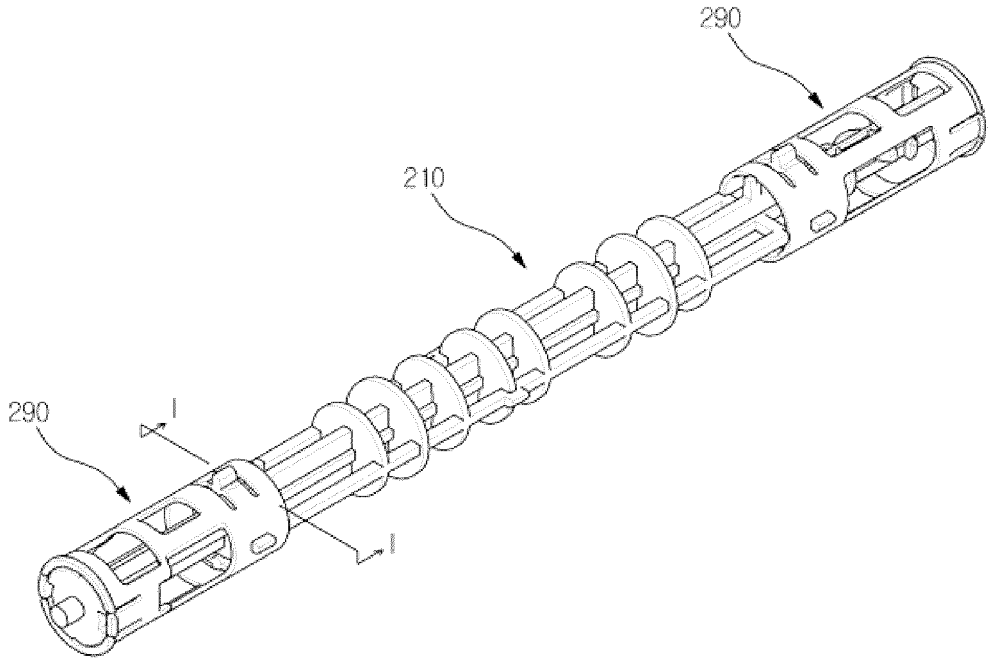
FIG. 5 is a perspective view illustrating a first rotation member and a torque limiter of the developing agent conveying apparatus of FIG. 4.
Figure 6:
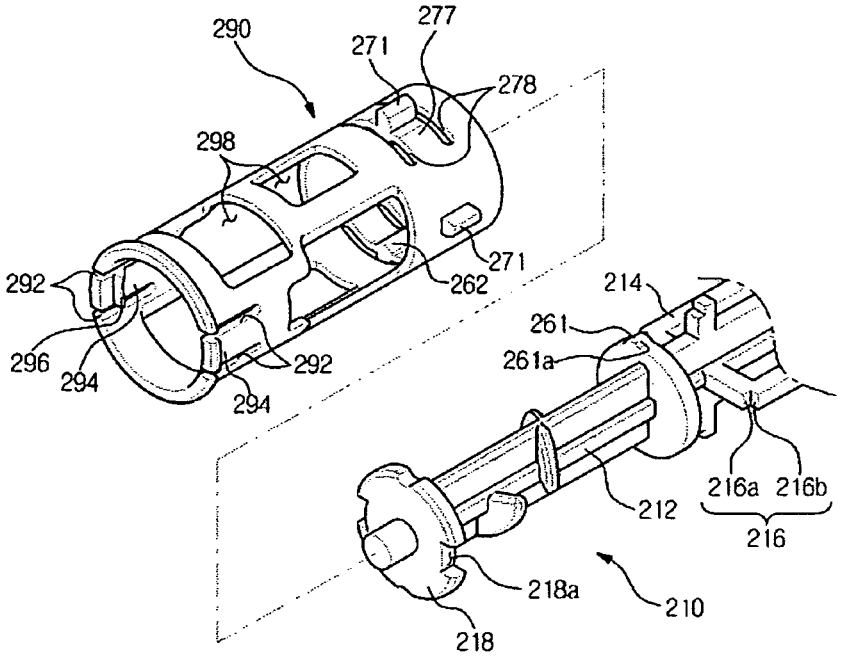
FIG. 6 is an exploded perspective view illustrating a first rotation member and a torque limiter of the developing agent conveying apparatus of FIG. 4.

FIG. 5 is a perspective view illustrating the first rotation member 210 and a torque limiter 290 of the developing agent conveying apparatus 200 of FIG. 4. FIG. 6 is an exploded perspective view illustrating the first rotation member 210 and the torque limiter 290 of the developing agent conveying apparatus 200 of FIG. 4.

Referring to FIGS. 5 and 6, the torque limiter 290 may be coupled to opposite ends of the first rotation member 210 in the shaft direction (i.e., direction X illustrated in FIG. 4) of the first rotation member 210. The first rotation member 210 includes a rotation shaft 212 that rotates by receiving a power from a motor (not illustrated), a plurality of agitator ribs 214 each extending from the rotation shaft 212 in a radial direction of the rotation shaft 212, a support unit 216 provided on at least one of the rotation shaft 212 and the agitator ribs 214 to support one end of the torque limiter 290, and a support rib 218 to support the other end of the torque limiter 290.

The rotation shaft 212 rotates by receiving a power from the motor. The agitator ribs 214 stirs the developing agent accommodated in the first developing agent accommodating compartment 102 illustrated in FIG. 2 while rotating together with the rotation shaft 212.

The support unit 216 includes a first support surface 216*a*, which makes contact with a cross section of one end of the torque limiter 290 to support the torque limiter 290 against the shaft direction (X) of the first rotation member 210, and a second support surface 216*b*, which makes contact with an inner surface of one end of the torque limiter 290 to support the torque limiter 290 against the radial direction of the first rotation member 210. The support unit 216 supports one end of the torque limiter 290 such that the torque limiter 290 is minimized and/or prevented from moving in the shaft direction (e.g., the X direction illustrated in FIG. 4) of the first rotation member 210 while being coupled to the first rotation member 210.

The support rib 218 is spaced apart from the support unit 216 by a predetermined distance corresponding to the length of the torque limiter 290. The support rib 218 supports the other end of the torque limiter 290 to minimize and/or prevent the torque limiter 290 from being separated from the first rotation member 210.

A locking prevention groove 218*a* formed in the support rib 218 can minimize and/or prevent a separation preventing unit 296 from being locked into the support rib 218 when the torque limiter 290 is coupled to the first rotation member 210.

The torque limiter 290 can include at least one first elastic piece 277 which has sides that are slit in a circumferential direction of the torque limiter 290. FIG. 6 illustrates the sides that are slit in the circumferential direction as first slit units 278. A second protrusion 260 protrudes from the first elastic piece 277 toward a center of the torque limiter 290. At least one third protrusion 271 protrudes from the first elastic piece 277 in an opposite direction to the second protrusion 262. The torque limiter 290 can include a plurality of the first slit units 278, each of which is formed by slitting a side surface of the torque limiter in a circumferential direction of the torque limiter while interposing the third protrusion 271 therebetween, such that the third protrusion 271 elastically moves in a radial direction of the torque limiter 290.

A second elastic piece 294, which performs an elastic motion in a radial direction of the torque limiter 290, is formed at the other end of the torque limiter 290 supported by the support rib 218. The second elastic piece 294 is provided between second slit units 292 that are formed by slitting a side surface of the torque limiter 290, which connects to the other end, in the shaft direction (e.g., the X direction illustrated in FIG. 4). The second elastic piece 294 elastically deforms to a radial outer side as the radius of the torque limiter 290 increases when the torque limiter 290 is coupled to the first rotation member 210, thereby preventing the separation preventing unit 296 from being locked into the support rib 218.

The second elastic piece 294 may include the separation preventing unit 296 that minimizes and/or prevents the torque limiter 290 from being separated from the first rotation member 210. The separation preventing unit 296 protrudes from an inner surface of the second elastic piece 294 toward the center of the torque limiter 290. The separation preventing unit 296 limits the movement of the torque limiter 290 by making contact with one surface of the support rib 218 when the torque limiter 290 moves to a direction, by which the first torque limiter 290 is separated from the first rotation member 210, thereby minimizing and/or preventing the torque limiter 290 from being separated from the rotation member 210.

The torque limiter 290 can include at least one through hole 298 which penetrates a side surface of the torque limiter 290 to reduce a resistive force applied to the first rotation member 210 by a developing agent existing between the torque limiter 290 and the first rotation member 210.

The torque limiter is coupled at an inner side to the first rotation member 210 to perform a relative rotation with respect to the first rotation member 210 through a first power transmission mechanism 260 illustrated in FIG. 2. The first power transmission mechanism 260 couples the torque limiter 290 to the first rotation member 210 while allowing a slip between the torque limiter 290 and the first rotation member 210.

Figure 7:
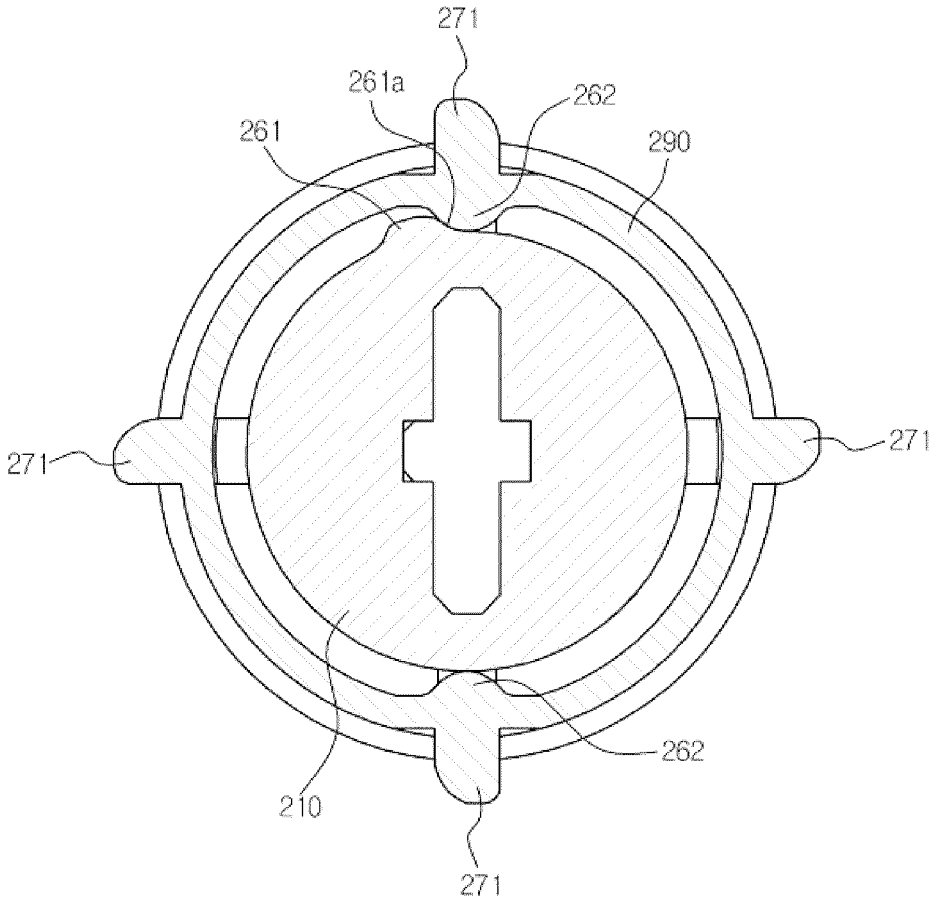
FIG. 7 is a cross sectional view taken along line 'I-I' of FIG. 5.

FIG. 7 is a cross-sectional view taken along line 'I-I' of FIG. 5.

Referring to FIGS. 4 and 7, the first power transmission mechanism 260 includes at least one first protrusion 261, which protrudes from an outer surface of the first rotation member 210, and at least one second protrusion 262, which protrudes from an inner surface of the torque limiter 290 (e.g., from a first elastic piece 277 as illustrated in FIG. 6).

The first protrusion 261 protrudes from the outer surface of the first rotation member 210 in a direction to which the radius of the first rotation member 210 increases. The second protrusion 262 protrudes from the inner surface of the torque limiter 290 in a direction, to which the radius of the inner surface of the torque limiter 290 decreases, to receive a power by making contact with the first protrusion 261. The first protrusion 261 is arranged in the circumferential direction of the first rotation member 210, and the second protrusion 262 is arranged in the circumferential direction of the torque limiter 290.

The first protrusion 261 makes contact with the second protrusion 262 when the first rotation member 210 is rotating, so that a rotary force is transmitted to the first developing agent convey belt 231 or the third developing agent convey belt 251 through the torque limiter 290. The first protrusion 261 allows the second protrusion 262 to be slipped and separated from the first protrusion 261 if a force that is greater than a predetermined overloading force is applied to the first developing agent convey belt 231 or the third developing agent convey belt 251.

The first protrusion 261 has a slip guide unit 261*a* that is formed at a surface of the first protrusion 261 facing the second protrusion 262 to guide a slip between the first protrusion 261 and the second protrusion 262. Referring to FIGS. 6 and 7, the slip guide unit 261*a* of the first protrusion 261 includes a concave surface having a predetermined curvature to minimize and/or prevent the first protrusion 261 from being too easily separated from the second protrusion 262 and to allow the second protrusion 262 to smoothly slip along the slip guide unit 261*a*.

The point of time at which a slip occurs between the first rotation member 210 and the torque limiter 290 is adjusted based on the height of the first protrusion 261, the height of the second protrusion 262, and the shape of the first and the second protrusions 261 and 262. That is, if the first protrusion 261 or the second protrusion 262 is provided in an approximate rectangular shape by increasing the height of the first protrusion 261 or the second protrusion 262 or decreasing the radius of curvature of the first protrusion 261 or the second protrusion, a slip between the first and the second protrusions 261 and 262 is inhibited. Accordingly, a slip may occur when the developing agent is conglomerated, and thus a load that is greater than a predetermined threshold load is applied to the first developing agent convey belt 231. If the first protrusion 261 or the second protrusion 262 is provided in an approximate round shape by decreasing the height of the first protrusion 261 or the second protrusion 262 or increasing the radius of curvature of the first protrusion 261 or the second protrusion, even when the load applied to the first developing agent convey belt 231 is relatively small, a slip can occur between the first and the second protrusion 261 and 262.

If an overload (e.g., an applied load that is greater than a predetermined threshold load) is applied to the first developing agent convey belt 231 of the third developing agent convey belt 251 due to a lump of the developing agent that exceeds a predetermined lump size, a slip occurs between the first protrusion 261 and the second protrusion 262, so that the first rotation member 210 runs idle without transmitting a rotary force to the torque limiter 290. Accordingly, the parts of the developing agent device are prevented from being damaged or deformed because the first rotation member 210 is not forcedly driven during a conveyance of an initial developing agent when the first rotation member runs idle.

When the first rotation member 210 runs idle, the plurality of agitator ribs 213 dissolves the conglomerated developing agent while rotating together with the rotation shaft 212. As the developing agent is dissolved, the load applied to the first developing agent convey belt 231 or the third developing agent convey belt 251 is reduced. After a predetermined period of time, the first protrusion 261 is engaged with the second protrusion 262, so the rotary force of the first rotation member 210 is transmitted to the first developing agent convey belt 231 or the third developing agent convey belt 251 through the torque limiter 290. Accordingly, the first developing agent convey belt 231 or the third developing agent convey belt 251 starts rotating to convey the developing agent.

Although the slip guide unit 261*a* is provided on the first protrusion 261 in FIGS. 6 and 7, the position of the slip guide unit 261*a* is not limited thereto. The slip guide unit 261*a* may be provided on the second protrusion 262 or on both of the first and the second protrusions 261 and 262.

The torque limiter 290 is coupled to the first developing agent convey belt 231 or the third developing agent convey belt 251 through a second power transmission mechanism 270. The second power transmission mechanism 270 is configured to allow the torque limiter 290 to rotate while being engaged with the first developing agent convey belt 231 or the third developing agent convey belt 251 without performing a relative motion with respect to the first developing agent convey belt 231 or the third developing agent convey belt 251.

Figure 8:
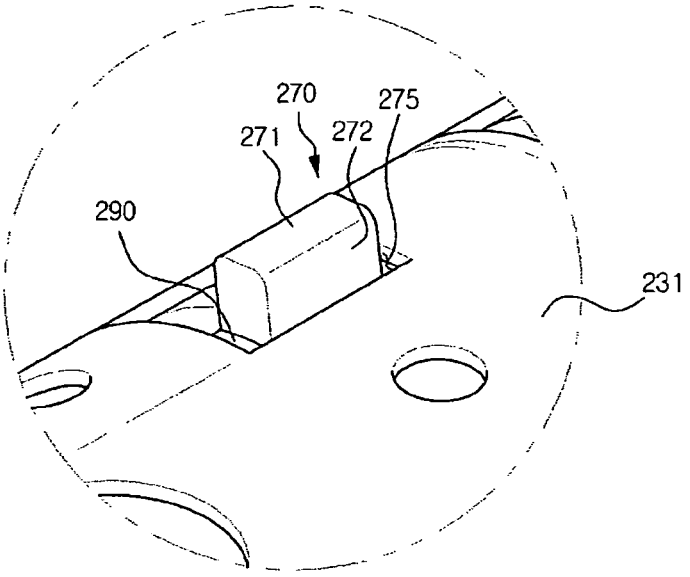
FIG. 8 is an enlarged perspective view illustrating a second power transmission mechanism of the developing agent conveying apparatus of FIG. 4.

FIG. 8 is an enlarged perspective view illustrating a second power transmission mechanism 270 of the developing agent conveying apparatus 200 of FIG. 4.

Referring to FIGS. 4, 5, and 8, the second power transmission mechanism 270 includes at least one third protrusion 271, which protrudes from an outer surface of the torque limiter 290 toward an outside of a radial direction of the torque limiter 290, and at least one accommodation hole 275, which is formed in the first developing agent convey belt 231 or the third developing agent convey belt 251 to accommodate the third protrusion 271. The at least one third protrusion 271 is arranged in the circumferential direction of the torque limiter 290. The at least one accommodation hole 275 is formed in the rotation direction of the first developing agent convey belt 231 or the third developing agent convey belt 251.

While the torque limiter 290 is rotating, the third protrusion 271 is coupled to the accommodation hole 275 to transmit a rotary force to the first developing agent convey belt 231 or the third developing agent convey belt 251. The third protrusion 271 is provided so as to minimize and/or prevent a separation of the third protrusion 271, which has been inserted into the accommodation hole 275 during transmitting a power, from the accommodation hole 275.

The third protrusion 271 has a contact surface 272 making contact with one surface of the accommodation hole 275. The contact surface 272 of the third protrusion 271 has a height extending toward the outside of the radial direction of the torque limiter 290 so as to minimize and/or prevent the accommodation hole 275 from being separated from the third protrusion 271 during the power transmission process.

Figure 9:
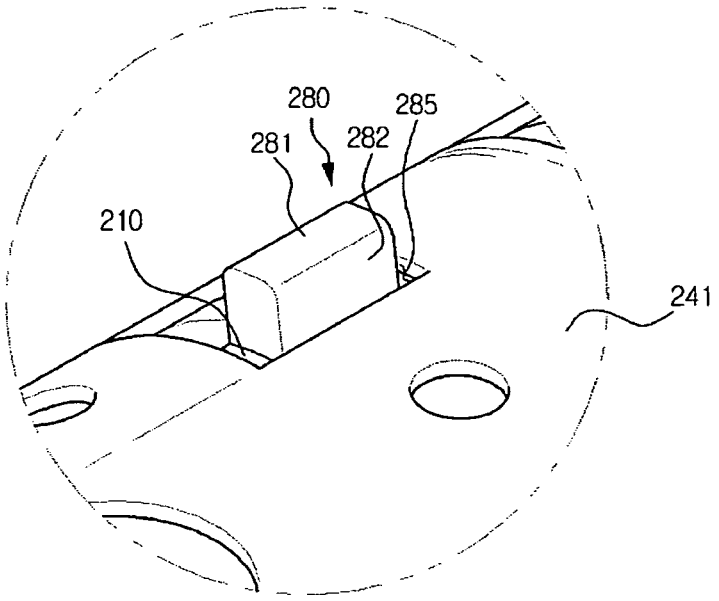
FIG. 9 is an enlarged perspective view illustrating a third power transmission mechanism of the developing agent conveying apparatus of FIG. 4.

FIG. 9 is an enlarged perspective view illustrating a third power transmission mechanism 280 of the developing agent conveying apparatus 200 of FIG. 4.

Referring to FIGS. 4, 5, and 9, a third power transmission mechanism 280 includes at least one fourth protrusion 281 protruding from the outer surface of the first rotation member 210 and at least one coupling hole 285 formed in the second developing agent convey member 241 to accommodate the at least one fourth protrusion 281. The at least one fourth protrusion 281 protrudes from the outer surface of the first rotation member 210 in a radial direction of the first rotation member 210 and is arranged in a circumferential direction of the first rotation member 210. The at least one coupling hole 285 is arranged in the rotation direction of the second developing agent belt 241.

While the first rotation member 210 is rotating, the fourth protrusion 281 is coupled to the coupling hole 285 to transmit a rotary force to the second developing agent convey belt 241. The fourth protrusion 281 is provided in a predetermined configuration capable of preventing a separation of the fourth protrusion 281, which has been inserted into the coupling hole 285 during transmitting a power, from the coupling hole 285.

The fourth protrusion 281 has a contact surface 282 making contact with one surface of the coupling hole 285. The contact surface 282 of the fourth protrusion 281 has a height extending toward the outside of the radial direction of the rotation member 210 to minimize and/or prevent the coupling hole 285 from being separated from the fourth protrusion 281 during the power transmission process.

Referring to FIG. 4, the developing agent convey belts 231, 241, and 251 include a plurality of convey protrusions 233, 243, and 253 and a plurality of opening units 235, 245 and 255. The convey protrusions 233, 243, and 253 protrude outward from the developing agent convey belts 231, 241 and 251 to supply and collect the developing agent. The opening units 235, 245, and 255 supply and collect the developing agent, reduce a stress applied to the developing agent, and reduce a driving torque of the developing agent convey belts 231, 241, and 251.

Hereinafter, the operation of the developing agent convey apparatus 200 will be described with reference to the accompanied drawings of FIGS. 1-9.

When the developing device 40Y is operated in the image forming apparatus 1, the developing agent contained in the first developing agent accommodating compartment 102 may be conglomerated after being collected to one side in the first developing agent accommodating compartment 102.

In this case, if the developing device 40Y is mounted on the body 10 and is driven, the lump of the developing agent applies a load to the first developing agent convey belt 231 that is greater than a predetermined threshold load, so that the first protrusion 261 fails to rotate without being engaged with the second protrusion 262 and the slip guide unit 261 a allows the first protrusion 261 to be slid and separated from the second protrusion 262. Therefore, the first rotation member 210 runs idle while the torque limiter 290 does not rotate. Accordingly, the parts of the developing agent device are prevented from being damaged or deformed as the first developing agent convey belt 231 is not forcedly driven when a load that is greater than the predetermined threshold load is applied.

The second developing agent convey belt 241 disposed in the middle (i.e., between the first developing agent convey belt 231 and the third developing agent convey belt 251) receives a rotary force through the third power transmission mechanism 280. Accordingly, the second developing agent convey belt 241 conveys the developing agent while rotating together with the first rotation member 210. At an opposite side to the first developing agent convey belt 251, a large load is not applied (i.e., a load that is less than a predetermined threshold load is applied). Accordingly, the third developing agent convey belt 251 corresponding to the opposite side to the first developing agent convey belt 251 rotates by receiving a rotary force through the first and the second power transmission mechanism 260 and 270.

As the second developing agent convey belt 241 and the third developing agent convey belt 251 rotate to convey the developing agent, the developing agent conglomerated at a side of the first developing agent convey belt 231 begins to have a fluidity and thus is dissolved to sides of the second and the third developing agent convey belts 241 and 251.

Accordingly, the load applied to the first developing agent convey belt 231 is reduced. After a predetermined period of time, the first protrusion 261 of the first rotation member 210 is engaged with the second protrusion 262 of the torque limiter 290 such that a power is transmitted to the torque limiter 290. Therefore, as the torque limiter 290 rotates, the third protrusion 271 of the torque limiter 290 is engaged with the accommodation hole 275 of the first developing agent convey belt 231 such that a power is transmitted to the first developing agent convey belt 231. Accordingly, the first developing agent convey belt 231 rotates and conveys the developing agent.

The above operation may be applied when the developing agent is conglomerated at a side of the third developing agent convey belt 251. The parts of the developing agent device can be minimized and/or prevented from being damaged or deformed when the developing agent is conglomerated at a side of the third developing agent convey belt 251.

Although the above description has been made in relation that three developing agent convey members are used, the number of developing agent convey members is not limited thereto. That is, the prevent general inventive concept may be applied to two developing agent convey members or applied to four or more developing agent convey members.

Although several embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. A developing device of an image forming apparatus, the developing device comprising:

a housing having a developing agent accommodating compartment disposed therein;

a first rotation member and a second rotation member that are disposed inside the developing agent accommodating compartment;

a plurality of developing agent convey members that rotate around the first rotation member and the second rotation member, the plurality of developing agent convey members being arranged along a shaft direction of the first rotation member; and at least one torque limiter coupled between the first rotation member and at least one of the plurality of developing agent convey members, the at least one torque limiter to allow at least one of the plurality of developing agent convey members to perform a relative rotation with respect to the first rotation member when a load applied to the plurality of developing agent convey members is varied.

2. The developing device of claim 1, further comprising:

a first power transmission mechanism to connect the at least one torque limiter to the first rotation member such that a slip is allowed between the at least one torque limiter and the first rotation member.

3. The developing device of claim 2, wherein the first power transmission mechanism comprises:

at least one first protrusion to protrude from the first rotation member; and at least one second protrusion to protrude from an inner surface of the torque limiter radially inward the torque limiter, wherein the at least one first protrusion or the at least one second protrusion is provided at one side thereof with a slip guide unit that guides a slip between the at least one first protrusion and the at least one second protrusion.

4. The developing device of claim 1, further comprising:

a second power transmission mechanism to connect the plurality of developing agent convey members to the at least one torque limiter such that the plurality of developing agent convey members rotate while being engaged with the at least one torque limiter.

5. The developing device of claim 4, wherein the second power transmission mechanism comprises:

at least one third protrusion to protrude from an outer surface of the at least one torque limiter radially outward from the at least one torque limiter; and at least one accommodation hole formed through the plurality of developing agent convey members to accommodate the at least one third protrusion.

6. The developing device of claim 5, wherein the torque limiter comprises:

a plurality of first slit units, each of which is formed by slitting a side surface of the torque limiter in a circumferential direction of the torque limiter while interposing the third protrusion therebetween such that the third protrusion elastically moves in a radial direction of the torque limiter.

7. The developing device of claim 1, wherein the torque limiter comprises:

at least one through hole which penetrates a side surface of the torque limiter to reduce a resistive force applied to the first rotation member by a developing agent existing between the torque limiter and the first rotation member.

8. The developing device of claim 1, wherein the at least one torque limiter is coupled at one end or at both ends of the first rotation member in the shaft direction of the first rotation member.

9. The developing device of claim 8, wherein the first rotation member comprises:

a rotation shaft to rotate when a driving force is received;

a plurality of agitator ribs which extend from the rotation shaft toward a radial direction of the first rotation member to stir a developing agent accommodated in the developing agent accommodating compartment; and a support unit which is provided on at least one of the rotation shaft and the plurality of agitator ribs to support the torque limiter, wherein the support unit comprises a first support surface to support the torque limiter against movement in the shaft direction of the first rotation member and a second support surface to support the torque limiter against movement in the radial direction of the first rotation member.

10. The developing device of claim 8, wherein the torque limiter comprises:

a separation preventing unit that protrudes from an inner surface of one end of the torque limiter toward a center of the torque limiter to prevent the torque limiter from being separated from the first rotation member in the shaft direction of the first rotation member.

11. The developing device of claim 10, wherein the torque limiter comprises:

a plurality of second slit units, each of which is formed by slitting a side surface of the torque limiter in the shaft direction of the torque limiter while interposing the separation preventing unit therebetween such that the separation prevention unit elastically moves in a radial direction of the torque limiter.

12. The developing device of claim 1, wherein the plurality of developing agent convey members comprise:

a first developing agent convey member and a third developing agent convey member that are disposed at opposite ends of the first rotation member in the shaft direction of the first rotation member; and a second developing agent convey member disposed between the first developing agent convey member and the third developing agent convey member.

13. The developing device of claim 12, wherein at least one of the first developing agent convey member and the third developing agent convey member perform a relative motion with respect to the second developing agent convey member.

14. The developing device of claim 13, further comprising:

a third power transmission mechanism to connect the second developing agent convey member to the first rotation member such that the second developing agent convey member rotates while being engaged with the first rotation member.

15. The developing device of claim 14, wherein the third power transmission mechanism comprises:

at least one fourth protrusion to protrude from the first rotation member; and at least one coupling hole formed through the second developing agent convey member in a rotation direction of the second developing agent convey member to accommodate the at least one fourth protrusion.

16. The developing device of claim 15, wherein if one of the first developing agent convey member and the third developing agent convey member is overloaded, the torque limiter, which is coupled between the overloaded developing agent convey member and the first rotation member, performs a relative rotation with respect to the first rotation member.

17. The developing device of claim 1, wherein the plurality of developing agent convey members are belts.

18. An image forming apparatus comprising:

a body;

a photoconductor which is disposed inside the body and has an electrostatic latent image formed thereon; and a developing device to provide the photoconductor with a developing agent, the developing device comprising:

a developing agent accommodating compartment;

at least one rotation member disposed in the developing agent accommodating compartment;

a plurality of developing agent convey members which convey the developing agent existing in the developing agent accommodating compartment while rotating around the at least one rotation member; and a plurality of torque limiters which are disposed between the at least one rotation member and the plurality of developing agent convey members and that are coupled to the at least one rotation member and the plurality of developing agent convey members such that at least one of the plurality of developing agent convey members performs a relative motion with respect to remaining developing agent convey members of the plurality of developing agent convey members.

19. The image forming apparatus of claim 18, further comprising:

at least one first protrusion to protrude from the at least one rotation member; and at least one second protrusion to protrude from at least one of the plurality of torque limiters and is engaged to or separated from the first protrusion according to a size of a load applied to the plurality of developing agent convey members.

20. The image forming apparatus of claim 19, further comprising:

a plurality of accommodation holes which are formed through at least one of the plurality of developing agent convey members and that are arranged in a rotation direction of the plurality of developing agent convey members; and at least one third protrusion to protrude from at least one of the plurality of torque limiters and is coupled to the plurality of accommodation holes to transmit a rotary force to the at least one of the plurality of developing agent convey members.

21. The image forming apparatus of claim 20, wherein at least one of the plurality of torque limiters further comprises at least one first elastic piece which has sides that are slit in a circumferential direction of the torque limiter, and wherein the second protrusion protrudes from the first elastic piece toward a center of the at least one torque limiter of the plurality of torque limiters.

22. The image forming apparatus of claim 21, wherein the third protrusion protrudes from the first elastic piece in an opposite direction to the second protrusion.

23. The image forming apparatus of claim 19, wherein the plurality of torque limiters include a first torque limiter coupled to one end of the rotation member and a second torque limited coupled to another end of the rotation member.

24. The image forming apparatus of claim 23, wherein one or more of the plurality of torque limiters further comprise:

at least one second elastic piece which has sides that are slit in a shaft direction of the plurality of torque limiters.

25. The image forming apparatus of claim 24, wherein the one or more of the plurality of torque limiters comprise:

a separation preventing member to protrude from an inner surface of the second elastic piece to prevent the one or more of the plurality of the torque limiters from being separated from the rotation member.

26. The image forming apparatus of claim 18, wherein the plurality of developing agent convey members comprise:

a first developing agent convey member and a third developing agent convey member that are disposed at opposite ends of the at least one rotation member in a shaft direction of the at least one rotation member; and a second developing agent convey member disposed between the first developing agent convey member and the third developing agent convey member, wherein the first developing agent convey member and the third developing agent convey member perform a relative motion with respect to the second developing agent convey member.

27. A developing agent convey apparatus of an image forming apparatus, comprising:

a first rotation member and a second rotation member disposed in a developing agent accommodating compartment and that are spaced apart from one another by a predetermined interval;

a plurality of developing agent convey members to convey developing agent stored the developing agent accommodating compartment while rotating around the first rotation member and the second rotation member; and a torque limiter that is coupled to the first rotation member and the plurality of developing agent convey members, the torque limiter being disposed between first rotation member and the plurality of developing agent convey members.

28. The developing agent convey apparatus of claim 27, further comprising:

a first power transmission member to connect the torque limiter to the first rotation member such that a slip occurs between the torque limiter and the first rotation member when a force that is greater than a predetermined overloading force is applied to at least one of the plurality of developing agent convey members.

29. The developing agent convey apparatus of claim 27, further comprising:

a second power transmission member to connect the plurality of developing agent convey members to the torque limiter such that the plurality of developing agent convey members rotate when engaged with the torque limiter.

30. The developing agent convey apparatus of claim 27, wherein the plurality of developing agent convey members comprise:

a first developing agent convey member and a third developing agent convey member that are disposed at opposite ends of the first rotation member in the shaft direction of the first rotation member; and a second developing agent convey member disposed between the first developing agent convey member and the third developing agent convey member.

31. The developing agent convey apparatus of claim 30, wherein when one of the first developing agent convey member and the third developing agent convey member is overloaded, the torque limiter, which is coupled between the overloaded developing agent convey member and the first rotation member, to rotate relative to the first rotation member.

* * * * *

UNITED STATES PATENT AND TRADEMARK OFFICE

CERTIFICATE OF CORRECTION

PATENT NO. : 8,948,664 B2
APPLICATION NO. : 13/548386
DATED : February 3, 2015
INVENTOR(S) : Jae Hyun Shin It is certified that error appears in the above-identified patent and that said Letters Patent is hereby corrected as shown below:

Claims

Claim 23, Column 19, Line 2

Delete "torque limited" and insert --torque limiter--, therefor.

Signed and Sealed this
Thirteenth Day of October, 2015

Michelle K. Lee

Michelle K. Lee
*Director of the United States Patent and Trademark Office*